US012392582B2

(12) United States Patent
Chukwu

(10) Patent No.: US 12,392,582 B2
(45) **Date of Patent: *Aug. 19, 2025**

(54) SATELLITE GUN

(76) Inventor: Ahamefula Chukwu, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/983,472

(22) Filed: Nov. 9, 2007

(65) Prior Publication Data

US 2009/0120275 A1 May 14, 2009
US 2009/0120275 A1 May 14, 2009

(51) Int. Cl.

| | |
|---|---|
| ***F41G 3/22*** | (2006.01) |
| ***F41A 19/58*** | (2006.01) |
| ***F41A 27/28*** | (2006.01) |
| ***F41C 33/06*** | (2006.01) |
| ***F41G 3/16*** | (2006.01) |
| ***F41G 5/06*** | (2006.01) |
| ***F41G 9/00*** | (2006.01) |

(52) U.S. Cl.
CPC ..... *F41G 9/00* (2013.01); *F41A 19/58* (2013.01); *F41A 27/28* (2013.01); *F41C 33/06* (2013.01); *F41G 3/165* (2013.01); *F41G 5/06* (2013.01)

(58) Field of Classification Search
CPC ..... F41H 11/06
USPC ..... 89/41.05
See application file for complete search history.

(56) References Cited

U.S. PATENT DOCUMENTS 2,247,842 A * 7/1941 Kamenarovic ..... F41A 27/28 89/37.17
3,136,215 A * 6/1964 Kalergios ..... F41G 3/22 89/41.21
3,742,812 A * 7/1973 Woodworth ..... F41G 3/165 348/169
3,829,659 A * 8/1974 Margolis ..... G06G 7/70 235/407
4,471,683 A * 9/1984 Brown ..... F41G 3/165 244/3.13
4,787,291 A * 11/1988 Frohock, Jr. ..... F41G 5/08 235/404
5,263,662 A * 11/1993 Fowler ..... F41G 3/22 89/41.21
5,331,881 A * 7/1994 Fowler ..... F41G 3/22 89/41.21
5,347,910 A * 9/1994 Avila ..... F41G 7/2293 89/41.22
5,379,676 A * 1/1995 Profeta ..... F41G 3/02 89/41.06
5,448,936 A * 9/1995 Turner ..... G01S 17/42 89/1.13
5,483,865 A * 1/1996 Brunand ..... F41G 3/22 89/41.21
5,822,713 A * 10/1998 Profeta ..... F41G 3/08 342/67
6,072,571 A * 6/2000 Houlberg ..... F41G 3/22 348/E7.086
7,168,357 B2 * 1/2007 Hodgkinson ..... 89/1.11
7,231,862 B1 * 6/2007 Quinn ..... 89/41.05
(Continued)

*Primary Examiner* — Derrick R Morgan

(57) ABSTRACT

The taboo act committed by terrorist and other types of trouble making people has become a menace among those who want to fight back this evil with the latest technology. The technology of the present invention is a wireless remote control gun for aircraft use, and the example of an aircraft is an airplane or drone.

1 Claim, 5 Drawing Sheets

(56) References Cited

U.S. PATENT DOCUMENTS

| | | | | |
|---|---|---|---|---|
| 7,493,846 | B2 * | 2/2009 | Quinn | F41G 3/16 89/205 |
| 7,542,828 | B2 * | 6/2009 | Steele | B64U 10/25 244/75.1 |
| 7,870,816 | B1 * | 1/2011 | Willingham | F41G 3/145 89/204 |
| 10,508,887 | B2 * | 12/2019 | Luszcz | F41G 5/18 |
| 2004/0050240 | A1 * | 3/2004 | Greene | F41A 23/24 89/41.06 |
| 2004/0134340 | A1 * | 7/2004 | Quinn | F41G 3/06 89/41.01 |
| 2006/0219094 | A1 * | 10/2006 | Padan | F41G 5/18 89/37.16 |
| 2014/0318426 | A1 * | 10/2014 | Chukwu | F41G 1/35 42/70.11 |
| 2015/0286373 | A1 * | 10/2015 | Chukwu | F41G 3/00 715/835 |
| 2019/0367169 | A1 * | 12/2019 | O'Leary | F41A 27/08 |
| 2023/0384059 | A1 * | 11/2023 | Couce | F41G 3/02 |

* cited by examiner

Schematic block diagram

SATELLITE GUN

BACKGROUND OF THE INVENTION

Field of Invention

The taboo act committed by terrorist and other types of trouble making people has become a menace among those who want to fight back this evil with the latest technology. The technology of the present invention is a wireless remote control gun for aircraft use, and the example of an aircraft is an airplane or drone.

The present invention is a wireless remote control gun for aircraft use, the gun is a fast and easy method to target and shoot at a terrorist(s) or to target or shoot at a target in a remote located from a flying aircraft that is mounted or installed with the said gun, which is called wireless remote control gun for aircraft use. The wireless remote control gun is specially designed to be mounted on the body of an aircraft or airplane or drone for use during war or for shooting at a target in a remote location and from a remote computer that is connected to internet network, for example the wireless remote control gun can be used for shooting at a target on the ground or on the air from a flying aircraft or airplane very easily and efficiently without the operator of the gun being onboard the flying aircraft or airplane or drone or helicopter. This wireless remote control gun is very unique because it can be mounted or secured to the external of an aircraft or airplane very easily and it can then be remotely operated from a remote location with the use of a remote computer connected to a monitoring internet site or network that is monitored and operated by a specially trained officer or person. This wireless remote control gun is very advance and will change warfare forever.

SUMMARY OF THE INVENTION

A computer connected to a network or to a website is needed for operating the gun, example a government website or any other network or website is needed for operating this wireless remote control gun for aircraft use and a specially trained person or a law enforcement officer will be assigned to operate the wireless remote control gun for aircraft use by logging into the said website or network to remotely access or control the gun to target or aim at a target that may be in a flying airplane or in a ground area that is located in a public or private place. The wireless remote control gun of this invention is mounted or installed by government agents in their areas of interest on the body of their military aircraft like airplane, helicopter or drone.

The present invention is more particular to a wireless remote control gun that is secured or mounted on the external of an airplane or on the external part of an aircraft body such as helicopter or drone to be remotely operated to target or shoot at a target from anywhere with the use of a remote computer that is monitored and that is connected to a website or network that is associated or connected to the gun. The technological idea of this invention is applicable for warfare use.

There are many types of ammunitions or projectiles that can be fire by the wireless remote control gun for aircraft use, for example, bullets and bombs.

The wireless remote control gun for aircraft use comes with some inbuilt property and some other external properties. The inbuilt properties are (1) a camera for real-time aiming and monitoring of a target visually from a remote computer monitor via a network or website. (2) a laser pointer for accurate aiming of a target or for shooting of shots, a government website or other any selected website or network will be uploaded with the necessary features or software for operating the wireless remote control gun for aircraft use.

The camera in the wireless remote control gun for aircraft use is a high resolution camera and it is configured to capture and send images of a target to a remote computer monitor via the network or website on real-time.

The camera on the wireless remote control gun for aircraft use will automatically capture and send a real-time motion pictures to a remote computer that is connected to the monitoring internet site or to the network or website that is used to view or to monitor any data or any images or picture captured by the camera on the embodiment of the gun.

The wireless remote control gun for aircraft use will automatically transmits and receives signal, data via the website or network wirelessly. The wireless remote control gun for aircraft use is designed with the best quality of electronics and mechanical components or materials. Government will decide where best to install the wireless remote control gun for aircraft use on the body of an airplane or aircraft or drone and the type of ammunition that will be fired by the wireless remote control gun for aircraft use in a particular situation, bullets and bombs are examples of the ammunitions that can be fired by the wireless remote control gun for aircraft use. The wireless remote control gun for aircraft use can also be secured or mounted on aircraft that may be assigned to fly over a war zone area to be operated by officer or user in a remote location with the use of the remote computer or with the computer monitor.

The wireless remote control gun for aircraft use comes with inbuilt camera and with inbuilt laser pointer secured or attached to the body of the wireless remote control gun for aircraft use. The laser pointer that is secured to body of the gun allows accurate aiming of shots when the wireless remote control gun for aircraft use is been remotely operated or monitored by a monitoring or aiming officer or person in a remote location through a computer monitor connected to the gun via a computer network or website. The inbuilt camera secured to the wireless remote control gun for aircraft use can capture images through the visible light or infrared light spectrums in very clear details.

DETAILED DESCRIPTION OF THE PREFERRED EMBODIMENT

Figure 1:
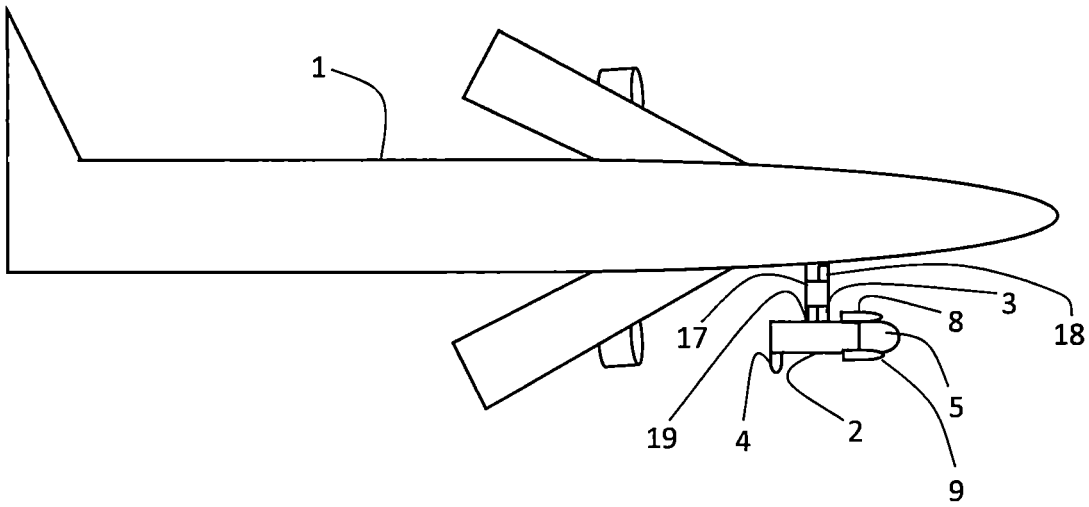
FIG. 1 to FIG. 4 describes the embodiment of the wireless remote control gun for aircraft use and the inbuilt properties and the types of ammunition it can fire and also the method of operating it against a target through the use of a remote computer connected to a remote computer network or website.
Figure 1:
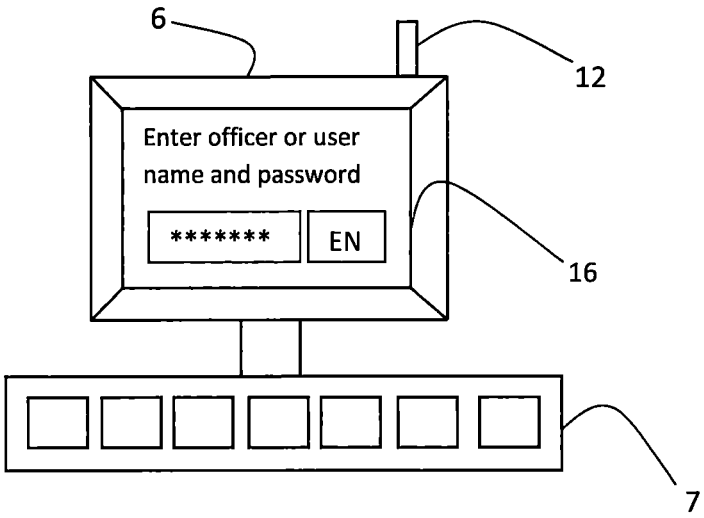

FIG. 1 show the embodiment of the wireless remote control gun for aircraft use 2 secured to an aircraft 1, FIG. 1 also show the remote computer 6 that is associated with the wireless remote control gun for aircraft use 2. The wireless remote control gun for aircraft use 2 is connected to the remote computer 6 through a network 12. The inbuilt monitor 16 on the remote computer 6 displays data from the remote computer 6. The wireless remote control gun for aircraft use 2 comes with the following inbuilt features, a camera 8 and a laser pointer 9 attached to the body of the gun 2, here is the gun barrel 5. The wireless remote control gun for aircraft use 2 is secured by a joint 17 to the aircraft 1 and a built-in electric motor 18 is connected to the joint 17, and another movable joint 3 is connected to the gun 2 with another electric motor 19 also connected to the body of the wireless remote control gun for aircraft use 2. The wireless remote control gun for aircraft use 2 is mounted on external part of the aircraft body 1 with the use of the connecting joints 3 and 17. The wireless remote control gun for aircraft use 2 has many inbuilt electrical, mechanical and electronic parts built in it, see FIG. 5. 4 is the area for inserting ammunitions, and 4 is shown on the embodiment of the wireless remote control gun for aircraft use 2. The wireless remote control gun for aircraft use 2 can fire many different types of projectiles or ammunitions like bullets, bombs or missile.

FIG. 1 also show the embodiment of the remote computer 6 that is configured for purpose of operating the wireless remote control gun for aircraft use 2, here is the computer keyboard 7.

Figure 2:
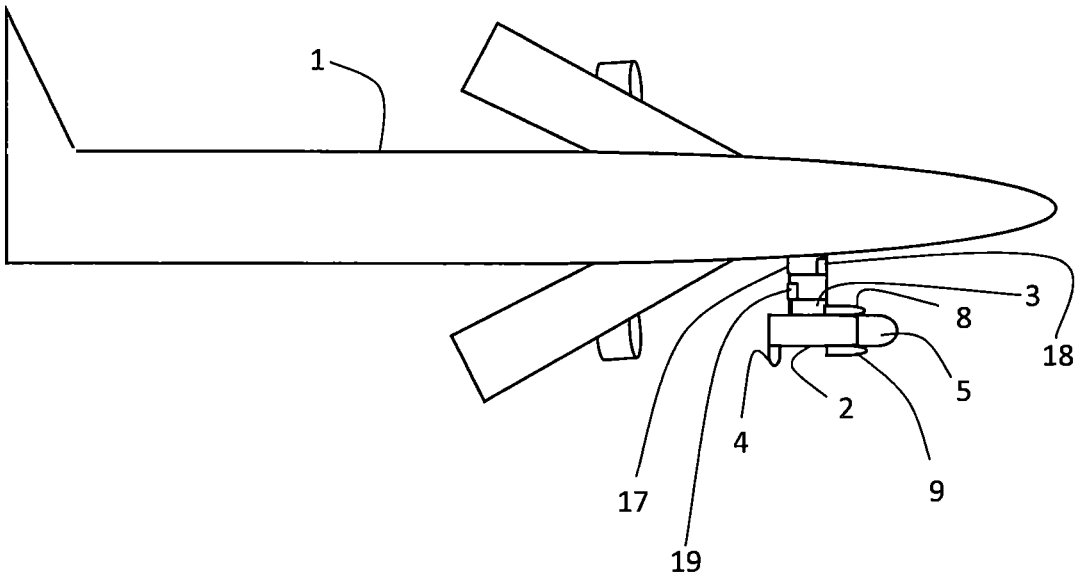
Figure 2:
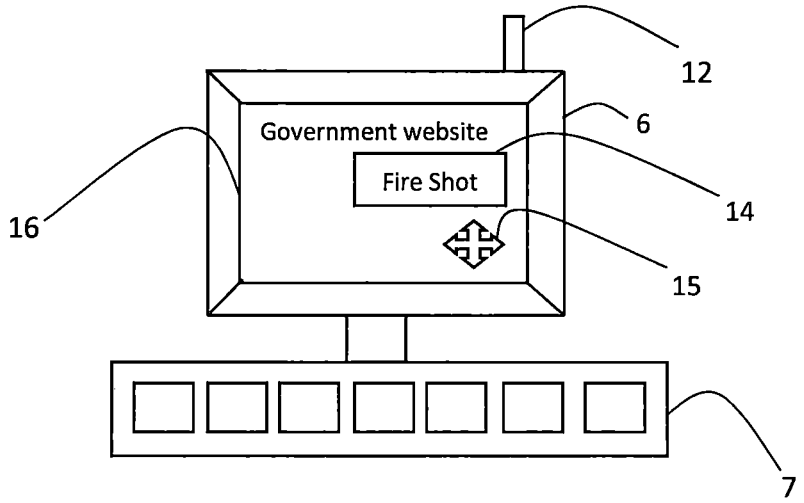

FIG. 2 is the embodiment of the wireless remote control gun for aircraft use 2 secured to the aircraft 1. FIG. 2 also show a remote computer 6 connected to internet network 12 or to any other special network, website or satellite network. The remote computer show on it a monitor 16 how to use any selected website or network to operate the wireless remote control gun for aircraft use 2, example of a name of a website is displayed on the monitor 16 stating government website.

A website or network is needed to operate the wireless remote control gun for aircraft use 2 and example of a website is displayed on the computer monitor 16 as government website and it is displayed on the monitor 16 on the embodiment of the remote computer 6, and the wireless remote control gun for aircraft use 2 is connected to the remote computer through a computer network, and a specially trained officer or user will be positioned on a location or on a site with the remote computer in other to operate the wireless remote control gun for aircraft use 2, officers or users are positioned on a remote location with the remote computer 6 with them and ready to operate the wireless remote control gun for aircraft use 2. The officers or users must enter a user name and password using the computer keyboard 7 and the officers must enter their username and password in the display on the computer monitor 16, see FIG. 1. There may be many wireless remote control guns for aircraft use 2 mounted on several aircraft located in different locations so all wireless remote control gun for aircraft use 2 will be coded with a specific access code for identification.

Many wireless remote control guns for aircraft use 2 can be operated from a selected website or network. Officer or user can monitor a particular wireless remote control gun for aircraft use 2 on the selected website or network by entering a specific access code on the remote computer monitor 16 for a particular wireless remote control gun for aircraft use 2.

When the code has been entered into the remote computer 6, the officer or user will use a computer mouse 7 to select the icon EN meaning enter, see FIG. 1. The code will allow the user to gain access to the wireless remote control gun for aircraft use 2. The user will then be able to monitor any motion picture capture by the inbuilt camera 8 in the wireless remote control gun for aircraft use 2 and also operate the wireless remote control gun for aircraft use 2.

Figure 3:
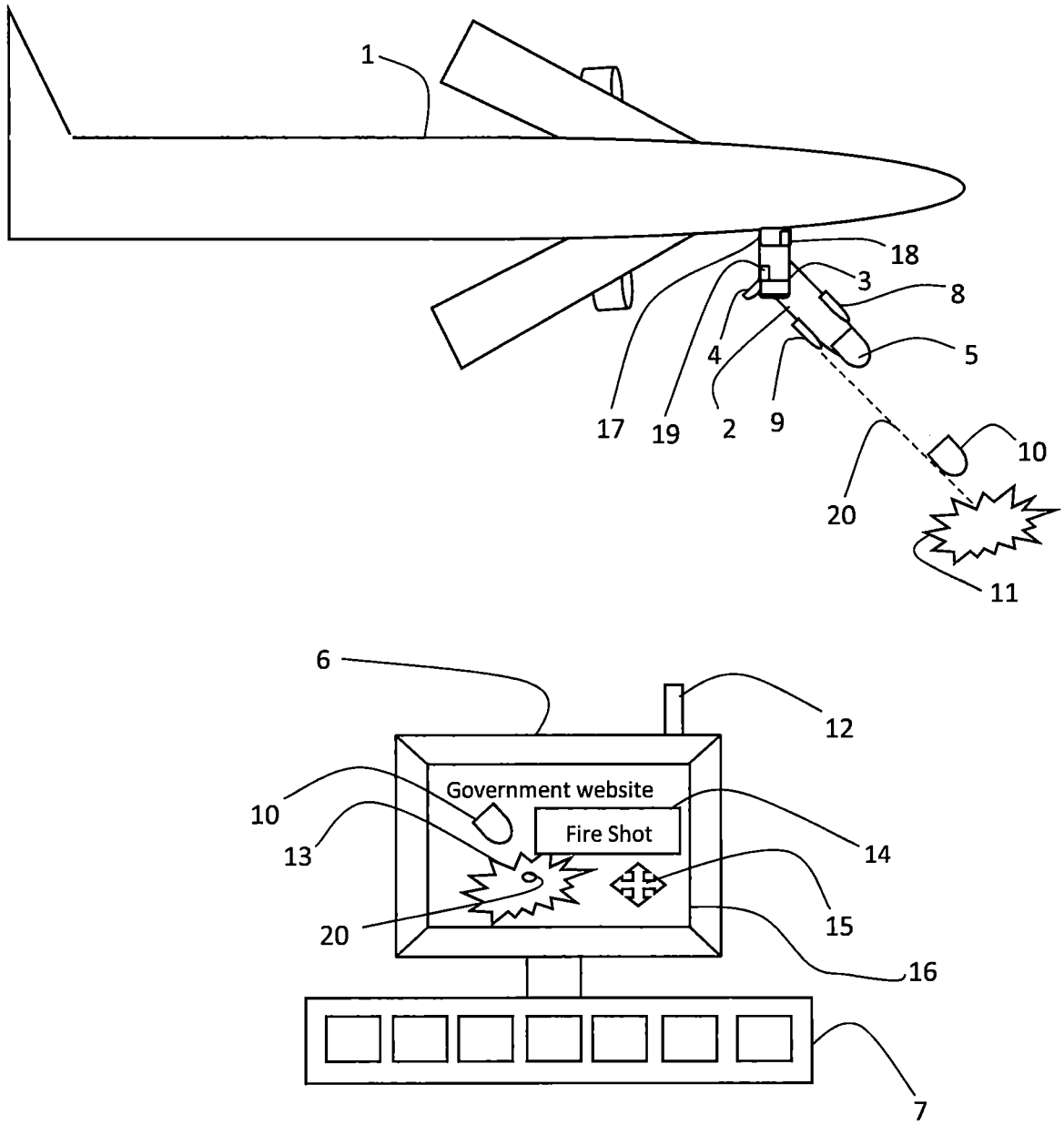

FIG. 3 shows the embodiment of the wireless remote control gun for aircraft use 2. FIG. 3 also shows the remote computer 6 that is connected to a network or website. The remote computer 6 is connected to internet network and the remote computer 6 displays and show how to use a selected website or network to remotely operate the wireless remote control gun for aircraft use 2.

There will be several methods for operating or controlling the wireless remote control gun for aircraft use 2. The wireless remote control gun for aircraft use 2 will be controlled with the use of a remote computer 6, by methods that includes touch screen, keyboard or joystick or by any special computer interface or controlling devices.

FIG. 3 also shows the embodiment of the wireless remote control gun for aircraft use 2. FIG. 3 also show the remote computer 6 connected to a website for operating the wireless remote control gun for aircraft use 2. The remote computer 6 is connected to a special website or network. The remote computer is connected to a website and the example of a website is shown on the remote computer as a government website and on the website it is shown how to operate and control the wireless remote control gun for aircraft use 2 on real time and also any images captured by the camera 8 on the embodiment of the wireless remote control gun for aircraft use 2 is displayed on the monitor 16 on the embodiment of the remote computer 6, there are four directional arrows 15 that are also displayed on the monitor 16 on the embodiment of the remote computer 6, see FIG. 2 and FIG. 3, these four directional arrows 15 are selected by the operating officer or user to remotely move the embodiment of the wireless remote control gun for aircraft use 2 to automatically point to any desired position or aiming position of the external target 11.

The inbuilt laser pointer 9 and the camera 8 in the gun will automatically point to focus to the desired position of the external target 11, see FIG. 3 this will occur when the wireless remote control gun for aircraft use 2 is being positioned by an operating officer or user, and also shot or shots can be fired when the operating officer or user select the fire shot icon displayed at the top right of the remote computer monitor 16. The operating officer or user selects the fire shot icon with the use of the keyboard 7 that is connected to the remote computer 6 or with the use of a computer mouse or a joystick or with the use of any other special type of computer interface or controlling devices.

FIG. 3 show the embodiment of the wireless remote control gun for aircraft use 2, FIG. 3 also show the embodiment of the remote computer 6 for operating the wireless remote control gun for aircraft use 2. The wireless remote control gun for aircraft use 2 is connected to a special computer network or website on the internet for operation. When the computer 6 is connected to the special network site or internet site designed for operating the wireless remote control gun for aircraft use 2 and a link is establish with when a special code is enter by the operating officer or user into the remote computer 6, and then the remote computer 6 will automatically connect to the wireless remote control gun for aircraft use 2 and the remote computer will automatically display steps on how to operate the wireless remote control gun for aircraft use 2. The path of the invisible or visible laser pointing light 20 that is pointing toward the target 11 is captured by the inbuilt camera 8 is automatically display on the remote computer 6 as it appear on the remote computer 6 as a pointing visible colored light dot 20 or spot 20. The pointing visible colored light spot 20 or dot 20 can be navigated by the operating officer or user to automatically point the gun at the target or to aim the gun and to shoot the gun at the direction of a target by using any type of interface control device like a mouse or joystick to grab the round dot 20 or spot 20 to point at the target 13 which automatically indicates the position of the laser pointing light on the target which is displayed on the remote computer monitor 6 on real time. The round dot 20 acts like a target icon and will automatically appears on the remote computer monitor 6. The round dot 20 is a target icon that is indicating the path or position of the laser pointing light 20 on real time and the dot can be moved by the operating user or officer to position the wireless remote control gun for aircraft use 2 to any preferred position of the target 11.

The embodiment of the wireless remote control gun for aircraft use 2 is mechanically moved by the operating officer or user who is operating the gun system through the website or network to point the gun 2 to the position of the target 11 when the round corner target icon 20 displayed on the monitor 6 which is indicating the position of the laser pointing light 20 is grabbed and moved to any position the embodiment of the gun 2 and the gun barrel 5 will automatically move or point to the position. The laser pointer and the camera which are attached to the embodiment of the wireless remote control gun for aircraft use 2 will uniformly point to the position of the round target icon or dot which is also the real time pointing position of the gun barrel 5 and shots are fired when the user select the fire shot icon that is displayed on the remote computer monitor 6.

The user selects the fire shot option with the use of a computer mouse, or a keyboard or with a joystick or any other type of computer interface device that is connected to the remote computer 6. There are many special software icons or programs icon that will be incorporated into the remote computer and will be use for operating the wireless remote control gun for aircraft use 2.

Figure 4:
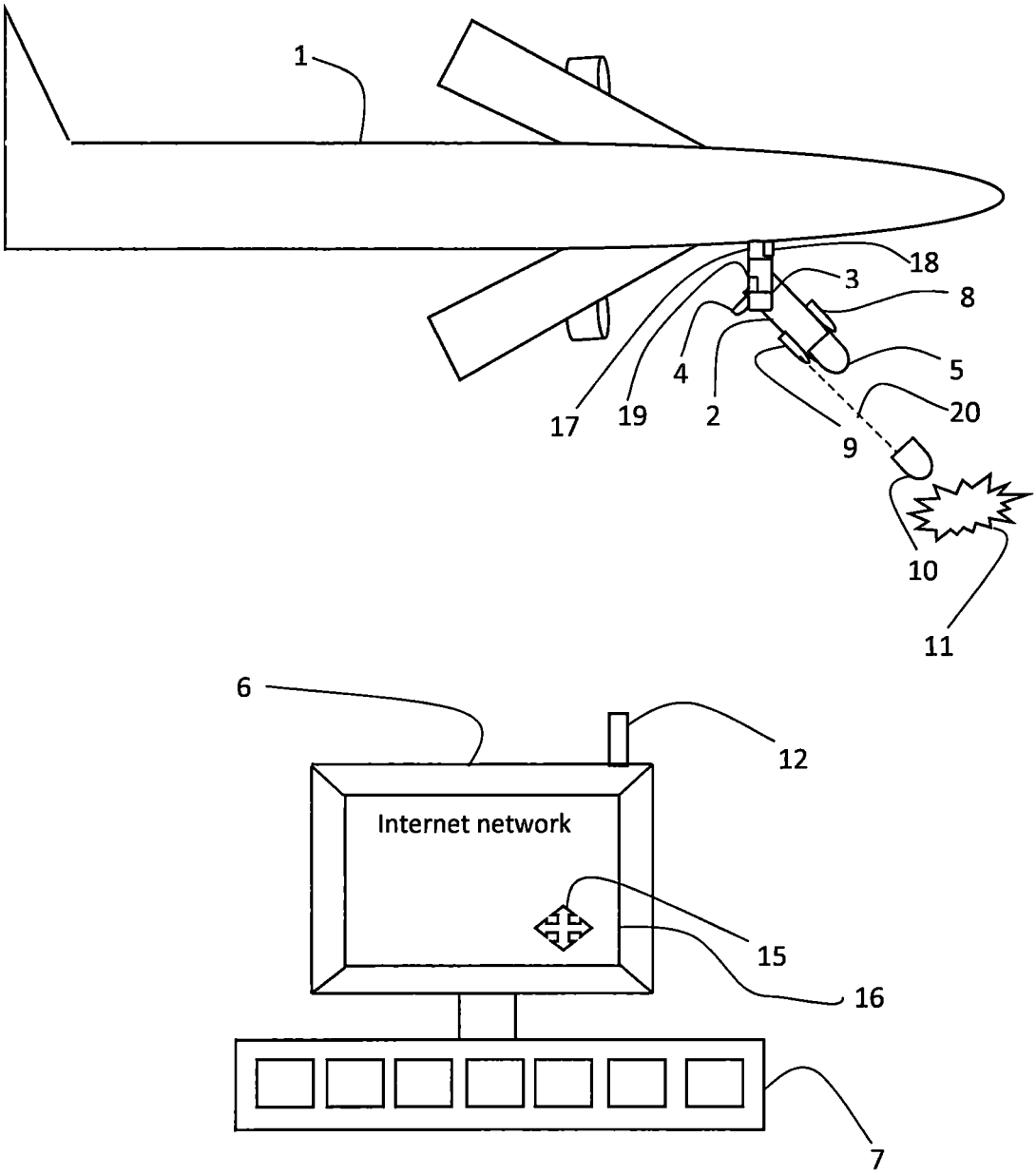

FIG. 4 is the embodiment of the wireless remote control gun for aircraft use 2, in FIG. 4 the wireless remote control guns for aircraft use 2 describes more on some of the parts of the wireless remote control gun for aircraft use 2, like the electric motor 17 that controls the left or right movement of the embodiment of the gun and the electric motor mechanism 3 controls the up or down movement of the embodiment of the gun 2. The left or right electric motor 17 functions to position the wireless remote control gun for aircraft use 2 to point to any degree across left or right position when the wireless remote control gun for aircraft use 2 is been operated or controlled by the operating officer or user. The up or down electric motor 3 functions to position the wireless remote control gun for aircraft use 2 to point to any degree across up or down position, when the wireless remote control gun for aircraft use 2 is been operated by the operating officer or person to do so. The wireless remote control gun for aircraft use 2 can be operated to point to any direction of the said position aiming or shooting out a projectile 10 at a target 11, in the laser pointing position 20, see FIG. 3 and FIG. 4.

Figure 5:
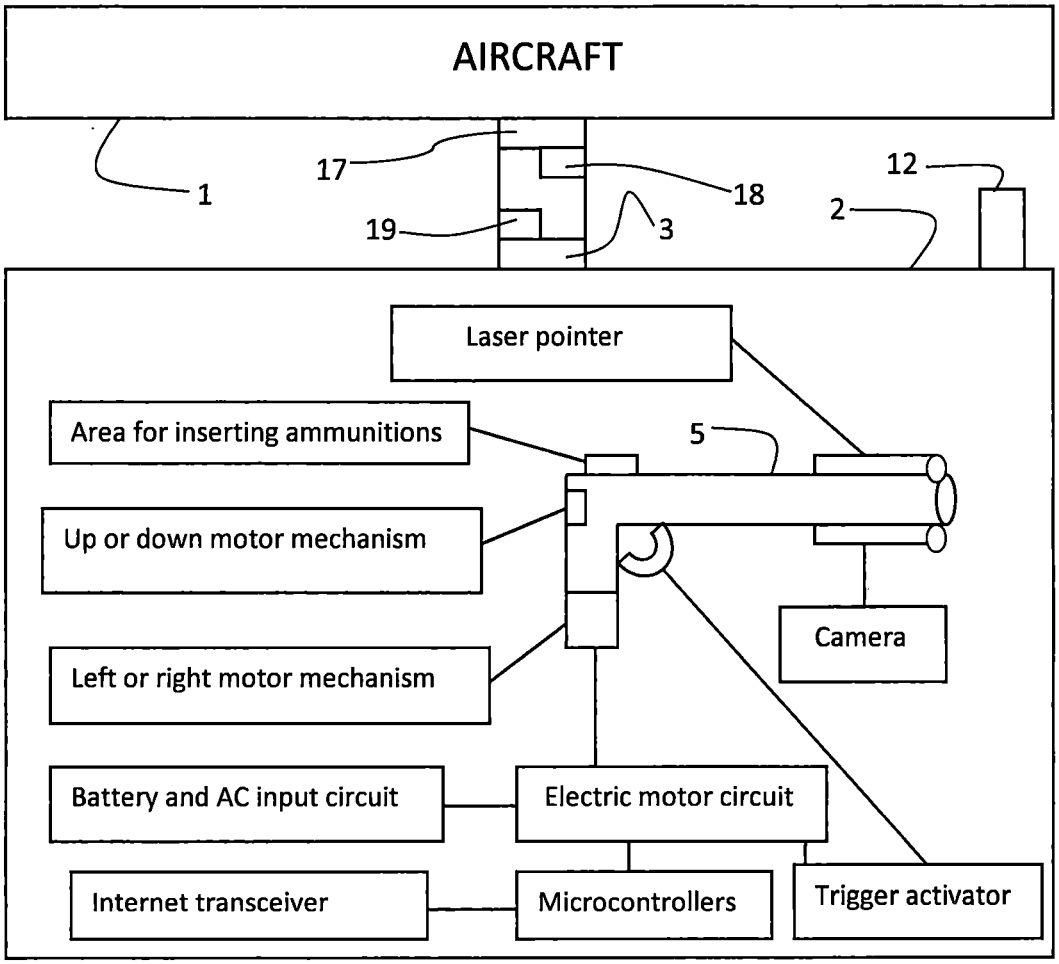
FIG. 5 describes the schematic block diagram of the embodiment of the wireless remote control gun for aircraft use.

FIG. 5 shows the schematic block diagram of the embodiment of the wireless remote control gun for aircraft use 2. The embodiment of the wireless remote control gun for aircraft use 2 is made up of the following parts which includes join 17 which is secured to the aircraft 1 and join 3 which is secured to the embodiment of the gun and the electric motor 19 and 18 which is associated with the joins, the embodiment of gun also includes electrical circuit, electronic circuits and many mechanical mechanisms which are built inside the wireless remote control gun for aircraft use 2 and they are describe below.

A battery and AC input circuit, internet transceiver, microcontrollers, left or right motor mechanism, up or down motor mechanism, camera and laser pointer, trigger activator, area for loading ammunitions or projectiles. The wireless remote control gun for aircraft use 2, has all the listed property and parts incorporated in it.

A battery or an ac power supply can power the wireless remote control gun for aircraft use 2. The battery and AC input circuit is the electrical circuit configured to link AC or DC current to the wireless remote control gun for aircraft use 2. The wireless remote control gun for aircraft use will be made with many special electronics circuit and electrical parts, which includes internet transceiver circuit that functions to receive and transmit signal to and from the network 12 to the wireless remote control gun for aircraft use 2. The wireless remote control gun for aircraft use 2 will also include many special microcontrollers.

The microcontrollers make the decision on all arithmetic or logic calculations of the wireless remote control gun for aircraft use. The electric motor 18 control the left or right movement of the motor mechanism and also the movement of the join 17, see FIG. 1 to FIG. 5, in addition the electric motor 19 control the up or down movement of the motor mechanism and also the movement of the join 3, see FIG. 1 to FIG. 5. The left or right motor mechanism functions to position the embodiment of the wireless remote control gun for aircraft use 2 to point to any degree across left or right position when the wireless remote control gun for aircraft use 2 is been operated or controlled by the operating officer or user with the use of the remote computer 6, see FIG. 1 to FIG. 4. The up and down motor mechanism functions to position the embodiment of the wireless remote control gun for aircraft use 2 to point to any degree across up or down position when the wireless remote control gun for aircraft use 2 is been operated or controlled by the operating officer or user with the use of the remote computer 6, see FIG. 1 to FIG. 4.

The camera functions to capture any motion picture detected in the pointing direction of the gun barrel 5 in the wireless remote control gun for aircraft use 2.

The laser pointer in the wireless remote control gun for aircraft use will generates an invisible or a colored visible laser beam 20 that is pointing in the direction of the target 11, see FIG. 3 and FIG. 4. The trigger activator activates the trigger in the wireless remote control gun for aircraft use 2 so that shot(s) can be fired. The trigger activator is made up of mechanical mechanism and electrical circuits. The wireless remote control gun for aircraft use 2 comes in different sizes and with an area for inserting ammunition or projectile like bullets or bombs.

The best of electrical parts, electronics parts, and mechanical parts, iron, steel, aluminum, plastic and many other special parts will be use in the production of the wireless remote control gun for aircraft use 2. I and many other skilled people will develop the wireless remote control gun for aircraft use 2, many more modification will be made to produce my invention but will not deviate from the idea and technology of my invention.

I claim:

1. A weapon system, comprising:

a remote control gun secured to the external part of an aircraft via a joint associated with a gun body;

the joint comprising a movable joint secured to the gun body;

the gun body comprising a barrel;

a camera secured to one side of the barrel of the gun body;

a laser pointer secured to the second side of the barrel of the gun body;

an external remote computer associated with the gun via an internet network;

a built-in internet connectable electronic circuit operably associated with an electric motor associated with the movable joint and with the gun body, the built-in internet connectable electronic circuit is configured to receive commands from the remote computer through a monitoring internet site, the built in internet connectable electronic circuit is configured to control the operation or movement of the gun body by the movement of the joint via the electric motor to point or to shoot a projectile at the direction of an external target;

wherein the laser pointer on the barrel of the gun body is configured for accurate aiming of shots;

wherein the camera on the barrel of the gun body is configured to capture and send real-time images of a target to the external remote computer through the monitoring internet site.

* * * * *